US005649520A

United States Patent [19]

Bednar

[11] Patent Number: 5,649,520

[45] Date of Patent: Jul. 22, 1997

[54] CROSSBOW TRIGGER MECHANISM

[75] Inventor: William J. Bednar, Akron, Ohio

[73] Assignee: Hunter's Manufacturing Co. Suffield, Ohio

[21] Appl. No.: 378,469

[22] Filed: Jan. 25, 1995

[51] Int. Cl.[6] ..... F41B 5/12

[52] U.S. Cl. ..... 124/25; 124/35.1; 124/40

[58] Field of Search ..... 124/25, 31, 35.1, 124/35.2, 40, 87; 33/233, 252, 254, 259

[56] References Cited

U.S. PATENT DOCUMENTS

| | | | |
|---|---|---|---|
| 1,192,639 | 7/1916 | Hunholz | 124/25 |
| 1,618,749 | 2/1927 | Blizard | 33/259 |
| 4,030,473 | 6/1977 | Puryear | 124/25 X |
| 4,192,281 | 3/1980 | King | 124/25 |
| 4,716,880 | 1/1988 | Adkins | 124/25 |
| 4,721,092 | 1/1988 | Waiser | 124/25 X |
| 4,877,008 | 10/1989 | Troubridge | 124/25 |
| 5,085,200 | 2/1992 | Horton-Corcoran et al. | 124/25 |

FOREIGN PATENT DOCUMENTS

| | | | |
|---|---|---|---|
| 80842 | 4/1919 | Switzerland | 124/25 |

*Primary Examiner*—John A. Ricci
*Attorney, Agent, or Firm*—Oldham & Oldham Co., LPA

[57] ABSTRACT

The present invention is directed to a crossbow trigger mechanism providing improved bowstring retention and release characteristics. The invention further provides a safe and reliable trigger mechanism which enhances accurate shooting with the crossbow. The trigger mechanism comprises a pivotal string release latch for releasably holding a bowstring in a drawn position. The string release latch is pivotable about a first pivot point and has associated therewith a first sear surface. The trigger mechanism further includes a pivotal rocker latch member having a second sear surface which engages the first sear surface on the string release latch to selectively prevent pivotal motion of the string release latch. The rocker latch member is pivotal about a second pivot point and has a portion thereof extending rearward of the second pivot point. A pivotal trigger is operable to pivot the rocker latch member and disengage the first and second sear surfaces to allow pivotal motion of the string release latch for selective release of the bowstring. The trigger is pivotal about a third pivot point and also has a portion thereof extending rearward from the third pivot point. The rearward extending portion of the trigger applies force on the rearward extending portion of the rocker latch member to cause pivoting thereof for disengagement of the first and second sear surfaces. The trigger mechanism is preferably encased within a housing which can be separately installed into a crossbow stock which is positively secured within the crossbow stock to prevent any relative movement therebetween. It is also a feature of the invention to provide an integral sight adjustment system for use with a rear sight of the crossbow. The sight adjustment mechanism is preferably integral to the trigger mechanism to allow simple and effective adjustment of the sight for a particular shooting distance.

27 Claims, 5 Drawing Sheets

CROSSBOW TRIGGER MECHANISM

BACKGROUND OF THE INVENTION

This invention generally relates to crossbows, and more particularly, to an improved trigger mechanism for use with a crossbow.

Crossbows in general have been used for many years as a weapon for hunting, fishing, and for target shooting. Significant development of the crossbow has occurred to increase the force with which an arrow is shot, increase shooting accuracy, and to make the crossbow safe. In general, the crossbow includes a stock incorporating a trigger mechanism for selectively holding and releasing a bowstring used to propel an arrow. The trigger mechanism used to hold and release a bowstring should allow a user to easily hold a drawn bowstring in a cocked position while prohibiting the bowstring from inadvertently releasing from the cocked position. The trigger mechanism must, therefore, positively hold a drawn bowstring, allowing release only upon actuation of a trigger. In many instances, crossbow trigger mechanisms do not incorporate safe and reliable release mechanisms which positively hold a drawn bowstring while allowing a smooth release to improve shooting accuracy.

Another important characteristic of a crossbow trigger mechanism involves the pressure and actuation characteristics of the trigger, affecting the smoothness and accuracy with which a drawn bowstring is released. The release characteristics of the trigger mechanism are therefore very important to the shooting accuracy and repeatability of a crossbow.

SUMMARY OF THE INVENTION

Based upon the foregoing, the present invention relates to a crossbow trigger mechanism with improved bowstring retention and release characteristics. The invention further provides a safe and reliable trigger mechanism which enhances shooting accuracy.

The crossbow trigger mechanism of the invention in a first embodiment comprises a pivotal string release member for releasably retaining a bowstring in a drawn position. The string release member is pivotable about a first pivot point and has associated therewith a first sear surface. The trigger mechanism further includes a pivotal rocker latch member having a second sear surface which engages the first sear surface of the string release member to selectively prevent pivotal motion of the string release member. The rocker latch member is pivotal about a second pivot point and has a portion thereof extending rearward of the second pivot point. A pivotal trigger is operable to pivot the rocker latch member and disengage the first and second sear surfaces to allow pivotal motion of the string release member for selective release of the bowstring. The trigger is pivotal about a third pivot point and also has a portion thereof extending rearward from the third pivot point. The rearward extending portion of the trigger applies force on the rearward extending portion of the rocker latch member to cause pivoting thereof for disengagement of the first and second sear surfaces.

The invention also has other distinct advantages. The trigger mechanism is preferably encased within a thin and compact housing which is separately installed into positive engagement with the barrel and stock of the crossbow. The trigger housing includes a forwardly opening bowstring slot into which the bowstring is drawn and engaged by the string release member of the mechanism. The height of the bowstring slot preferably closely matches the diameter of the bowstring, substantially preventing oscillations of the bowstring as it is released from the mechanism. The trigger housing is positively secured within the crossbow stock to prevent any relative movement, allowing down pressure provided on the string for retention by the trigger mechanism to be minimized.

The trigger housing may also be provided to allow flexibility in the type of trigger mechanism provided therewith, with both a simple, less costly trigger mechanism or a somewhat more complex mechanism used with the same housing design, with each trigger mechanism being interchangeably used with the housing.

The trigger mechanism further provides distinct advantages by minimizing trigger pull weight necessary to release a drawn bowstring. The trigger pull weight may be adjustable to allow the user to customize the "feel" of the trigger, and to allow flexibility for use when hunting, target shooting or for other uses. It is also a feature of the invention to provide an integral sight adjustment system for use with the crossbow's rear sight. The sight adjustment mechanism allows simple and effective adjustment of the sight for a particular shooting distance. The crossbow and trigger mechanism provide these and other distinct advantages in a durable and cost-effective design.

BRIEF DESCRIPTION OF THE DRAWINGS

The advantages and objects of the invention will be further understood by reference to the following description of preferred embodiments, taken in connection with the accompanying drawings, wherein.

DETAILED DESCRIPTION OF THE INVENTION

Figure 1:
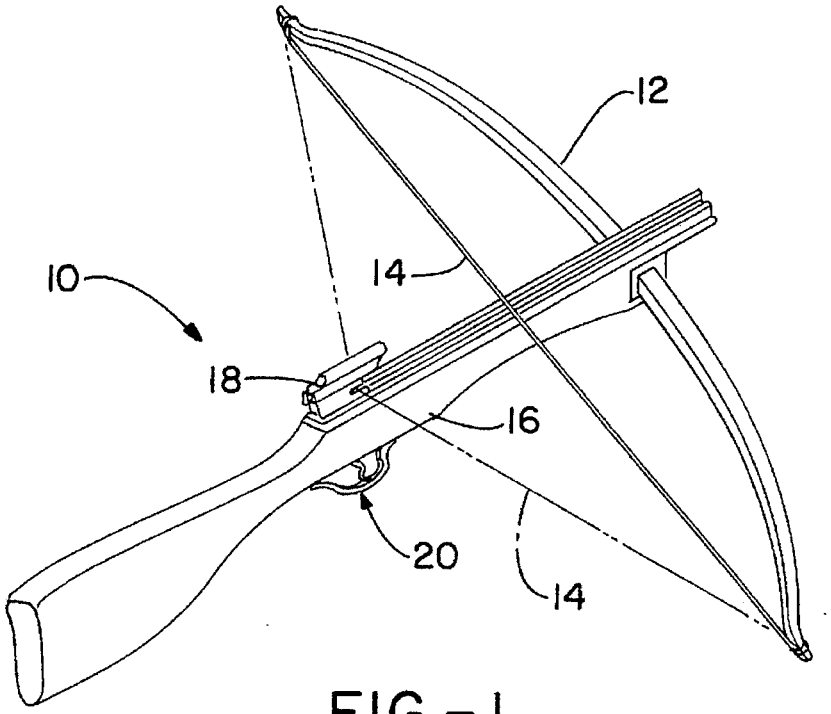
FIG. 1 is a schematic side view of a crossbow including a trigger mechanism in accordance with the invention.

Referring now to FIG. 1, there is shown a crossbow 10 which in general includes a bow section 12 having a bowstring 14 associated therewith, and a stock section 16 which is held for firing of the crossbow 10 by the user in a manner similar to a rifle. A trigger mechanism 20 is used to release the bowstring 14 from a drawn position as shown in ghost for firing of an arrow. A rear sight 18 may be used to aim the crossbow 10 along with a front sight (not shown) to increase shooting accuracy.

Figure 2:
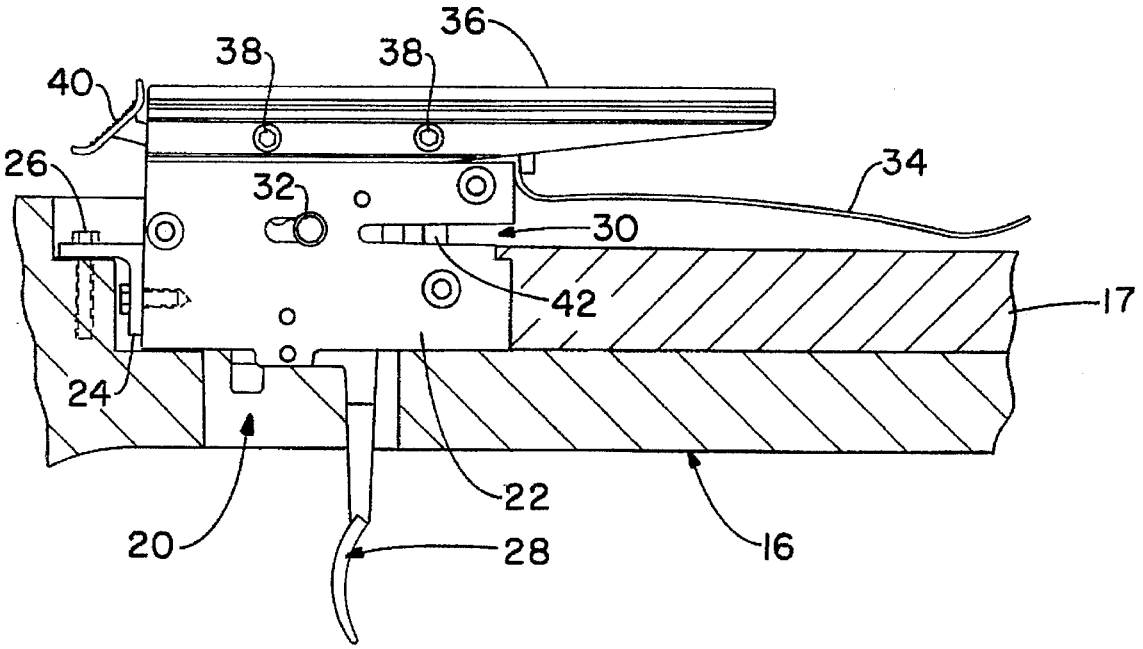
FIG. 2 is a partial section view of the crossbow as shown in FIG. 1, showing the trigger mechanism mounted in the crossbow stock.

Turning to FIG. 2, the trigger mechanism 20 of the invention is shown mounted in the crossbow stock 16. In the preferred embodiment, the trigger mechanism 20 is encased within an outer housing 22, which holds all components of the trigger mechanism to allow it to be completely removed from the stock 16 for adjustment or repair. To allow the housing 22 of trigger mechanism 20 to be positively locked within the stock 16, a securing means such as a tang 24 is associated with the case 20 at a rearward portion thereof. The tang 24 may be a separate member which is firmly and solidly connected to the stock 16 of the crossbow and to the trigger mechanism to eliminate any possibility of movement between the trigger mechanism 20 and stock 16. Alternatively, the tang 24 or other securing means may be made as an integral part of housing 22. A fastener 26 may extend deeply into the stock 16 to secure the tang 24 in place, and in the preferred embodiment, will extend at least an inch into the stock 16. The tang 24 is preferably L-shaped, with two substantially perpendicular portions, wherein one of the perpendicular portions is secured or integral to trigger housing 22, while the other portion is secured to stock 16 in a direction which is substantially perpendicular to the longitudinal axis of stock 16. In this manner, movement of trigger housing 20 is prevented along the axis of stock 16, and any shock or vibration imposed on tang 24 from the trigger housing 22 will be translated through tang 24 in a direction perpendicular to the fastener 26 to prevent loosening. The tang 24 may be constructed of a glass reinforced nylon material, which effectively absorbs vibration and shock forces to prevent their transmission through the stock 16. Although the use of tang 24 has been found to positively secure the housing 22 within stock 16, other methods of securing the trigger mechanism 20 within the stock 16 may be used if desired.

The trigger mechanism 20 also includes a trigger arm 28, which is pulled rearward by the user to release a drawn bowstring from the mechanism. The trigger housing 22 further includes a forward opening bowstring slot 30, which is designed to closely match the diameter of the crossbow bowstring. As a preferred example, the opening 30 will be dimensioned to be 0.015 inches greater than the bowstring diameter, such that upon release of the bowstring from the trigger mechanism, the bowstring cannot raise up or oscillate. Minimizing oscillation of the bowstring upon release from the trigger mechanism enhances shooting accuracy of the crossbow.

In use, the bowstring will be drawn under the retention spring 34 and into the string slot 30, where it will be engaged and held in a drawn position by means of a string release latch 42 shown in a position to hold the drawn bowstring. To disengage the string for firing of the crossbow, the trigger 28 is pulled, to allow the string release latch 42 to pivot out of the way, providing smooth release of the bowstring from the trigger mechanism 20.

The trigger mechanism 20 further includes a safety fever 32, which is used to lock the trigger mechanism to prevent firing of the crossbow as desired. Operation of the safety lever 32 will prevent or allow operation of trigger 28, allowing firing of the crossbow only when desired. A forwardly extending retention spring 34 extends along the barrel 17 to secure an arrow along the barrel 17. At the upper portion of the trigger mechanism 20, there may be provided a mounting platform 36 for a rear sight or scope to aid the user in aiming the crossbow accurately. The platform 36 may be referred to as a sight bridge which is secured to the housing 22 by means of bolts 38 or the like. As will be described later, vertical adjustment of a portion of the sight bridge 36 may be accomplished by means of an adjustment mechanism 40, for adjustment of a rear peep sight or scope. In the preferred embodiment, the adjustment mechanism 40 for the sight bridge 36 allows the user to select various shooting distances with great accuracy by operating the lever with the thumb.

Figure 3:
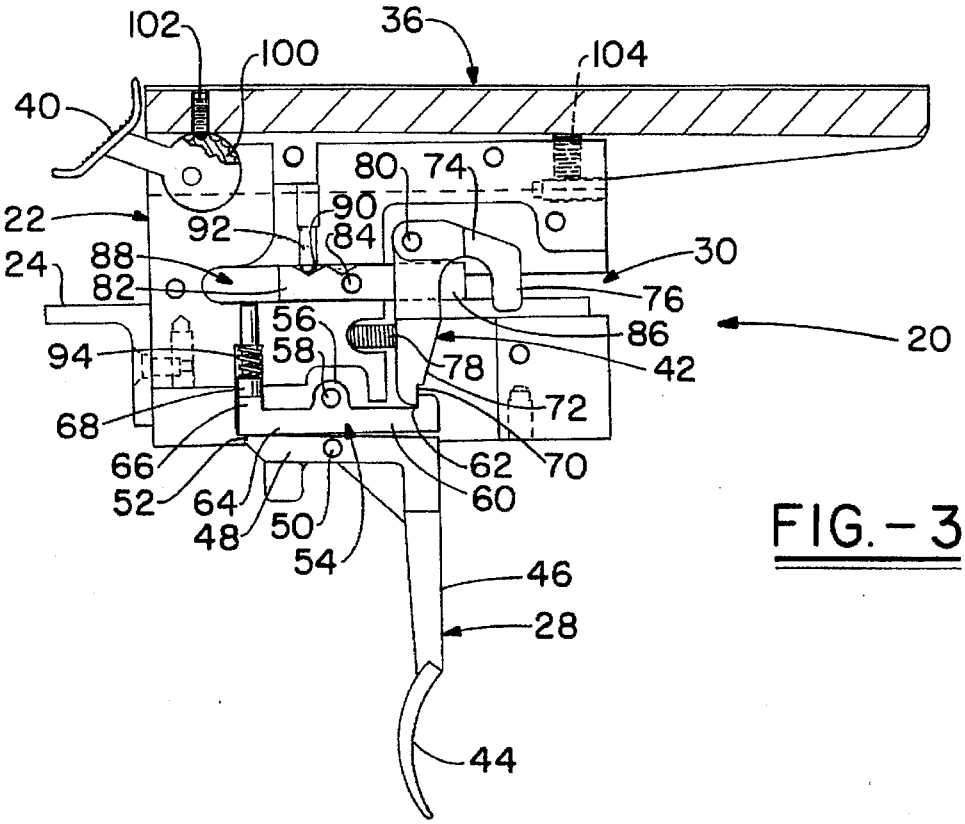
FIG. 3 is a side elevation view of a first embodiment of the trigger mechanism shown in FIG. 2 with half of the outer housing removed, the trigger mechanism shown in a bowstring retaining position.
Figure 4:
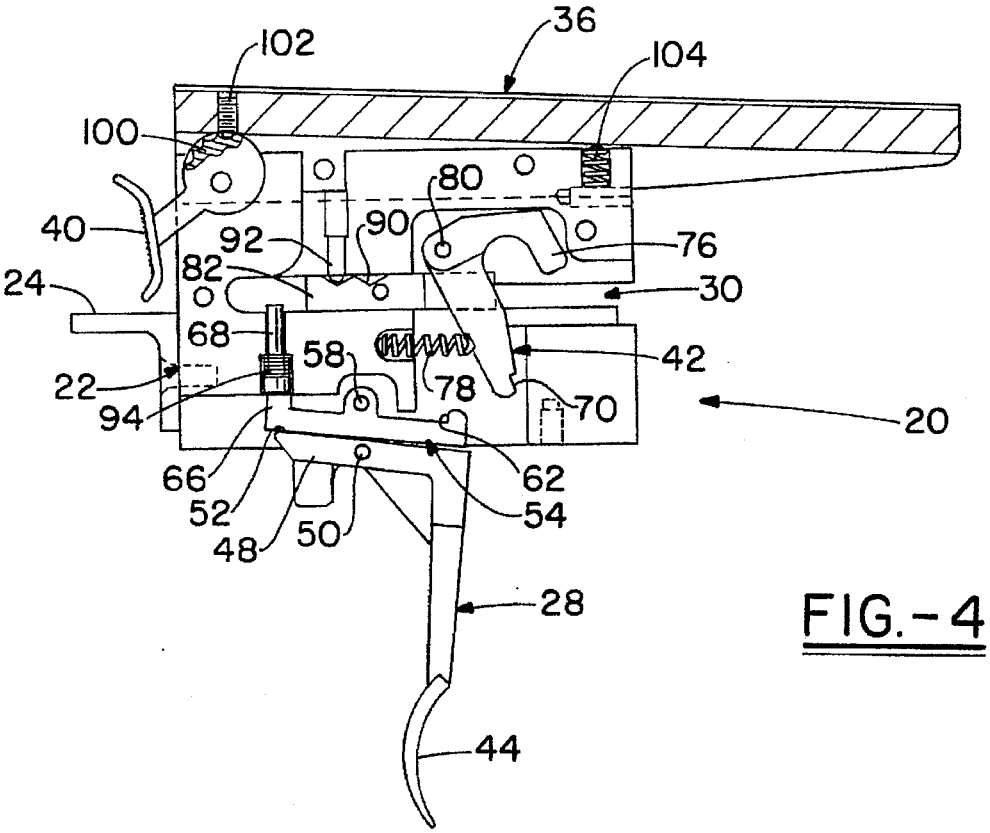
FIG. 4 is a side elevation view of the trigger mechanism as shown in FIG. 3, with the trigger actuated to release a bowstring.

Turning to FIGS. 3 and 4, further details of a first embodiment of the trigger mechanism 20 will be described. In the preferred embodiment, the trigger housing 22 is constructed of first and second sides which are fitted together to encase the components of the trigger mechanism. In FIGS. 3 and 4, the first side of trigger housing 22 has been removed to show the components of the trigger mechanism in their assembled configuration. In FIG. 3, the trigger mechanism 20 is set for firing, with the components of the trigger holding the string release latch 42 in a string-engaged position. As shown in FIG. 3, the trigger mechanism 20 includes a trigger 28 having a finger-engaging part 44, used to activate the trigger 28 and fire the crossbow. The part 44 is located on the distal end of a first arm 46 which projects downward out of the trigger housing 22 to make trigger 28 accessible to the user. The trigger 28 further includes a second arm member 48, extending rearward at substantially right angles to the first arm 46. At approximately a mid-point of second arm 48, a first pivot pin 50 extends through an aperture formed in the second arm 48 to pivotally mount trigger 28 within housing 22. In the preferred embodiment, the rearward upper edge of second arm member 48 may have a radiused upper corner providing a bearing surface 52 with a reduced coefficient of friction. The trigger 28 is used to actuate a separate rocker latch member 54 by means of the bearing surface 52 of the second arm 48. The rocker latch member 54 is an elongated member provided with an upward extending boss portion 56 having an aperture through which a second pivot pin 58 is inserted to pivotally mount rocker latch member 54 within trigger housing 22. In the preferred embodiment, the second pivot pin 58 is located directly above first pivot pin 50 located in the second arm 48 of trigger 28, at a predetermined distance away from first pivot pin 50 so as to optimize cooperation between trigger 28 and rocker latch member 54. A forward extending arm 60 of rocker latch member 54 includes an upwardly extending sear surface 62 at its end. The rearward extending arm 64 of rocker latch member 54 preferably includes an upwardly extending boss 66 which encounters a trigger stop 68 and is designed to prevent actuation of the trigger mechanism 20. In association with trigger stop 68, a spring 94 exerts a downward force on a head portion of stop 68, to bias stop 68 against the upwardly extending boss 66 of the rocker latch member 54. The trigger stop 68 cooperates with the safety mechanism to be hereinafter described to lock out operation of trigger mechanism 20. The string release latch 42 includes a downward extending arm 72 having a second sear surface 70 located at its end. String latch 42 also includes an upper, forward extending arm 74 with fork 76 that engages the bowstring when cocked.

It should be recognized with reference to FIG. 3 that in the positions shown, the rocker latch member 54 engages string release latch 42 by means of the cooperating sear surfaces 62 and 70. A spring member 78 is located within a small cavity formed in the second part of trigger housing 22 to apply force to the string release latch 42 to pivot on a pivot pin 80 located between arms 72 and 74 on which string release latch 42 is mounted. Upon disengagement of sear surfaces 62 and 70, spring 78 will pivot member 42 on pivot point 80 to bias fork portions 76 upward, ensuring that the trigger mechanism 20 is set for subsequent cocking of the bowstring. In this way, the fork 76 will not be an obstacle to insertion of the bowstring into slot opening 30. Situated behind string release latch 42 in a recess formed within trigger housing 22, a safety slide 82 is slidably positioned. The safety lever 32, previously mentioned, extends through an aperture 84 formed in the slide 82 and projects outward from housing 22 to manually actuate the slide 82 within housing 22. The safety slide 82 has a forward extending portion 86 which projects through the forked notch formed in string release latch 42 so as to extend into the string slot 30 when safety slide 82 is positioned as shown in FIG. 3. In this position, the trigger mechanism is cocked and ready to fire. Upon subsequent recocking of the crossbow, the bowstring will contact portion 86 of safety slide 82. As the bowstring is inserted into guide 30, the safety slide 82 slides rearward to automatically set the safety. The safety is set upon rearward movement of slide 82 into the recess 88 such that its rearward portion extends over an aperture 89 communicating with recess 88. The trigger stop 68 is slidable into recess 88 through aperture 89 as seen in FIG. 4. Rearward movement of slide 82 over the aperture inhibits movement of trigger stop 68 upwardly into recess 88, whereupon movement of the rocker latch member 54 and correspondingly of trigger 28 is prevented. The safety slide 82 may include a plurality of notches 90 which cooperate with an adjustable assembly 92 comprising which may comprise a ball bearing, spring, and set screw assembly, positioned within trigger housing 22 so as to extend downwardly and engage one of notches 90. The notches 90 maintain position of slide 82 in its forward or rearward position. The notches 90 preferably have angled surfaces, wherein force applied to slide 82 will cause assembly 92 to be displaced upward until it engages the other of the notches 90.

Also shown in FIG. 3, the sight bridge 36 is mounted on top of the trigger housing 22. An adjustment mechanism including thumb operated lever 40 associated with the sight bridge 36 to provide vertical adjustment of the rear portion of said bridge 36 in relation to housing 22 and, therefore, in relation to the crossbow in which housing 22 is secured. Incremental adjustment of the sight bridge allows for selective adjustment of a rear sight or other optical system used for sighting purposes. As will be described in more detail later, the adjustment mechanism may include a cam mechanism 100 which cooperates with a pin 102 positioned in an aperture extending downwardly through sight bridge 36. The pin 102 may preferably be a set screw which may be finely adjusted within the aperture so as to extend a predetermined distance outward from sight bridge 36 to coact with cam mechanism 100. An upward bias force is applied to sight bridge 36 at a forward portion of trigger housing 22 by means of a spring 104 to bias the set screw 102 against cam mechanism 100. The entire sight bridge 36 may therefore be tilted relative to housing 22 at a predetermined angie, to facilitate use of a rear sight or the like for firing at different distances using the crossbow.

As shown in FIG. 4, when the safety slide 82 is positioned at its forward position within recess 88, trigger stop 68 may be moved upwardly against the bias force of spring member 94 to extend within cavity 88. Free movement of the trigger stop 68 in this manner allows the rocker latch member 54 to pivot on its pivot point 58 within housing 22. Pivoting of rocker latch member 54 is performed by operation of trigger 28, which is manually pivoted about its pivot point 50 by the user. Upon pivoting of rocker latch member 54, sear surface 62 of the rocker latch member 54 will disengage from the sear surface 70 of string release member 42. Release of the sear surface 70 allows string release latch 42 to pivot on its pivot point 80, such that string-engaging fork 76 is pivoted upward for smooth release of a string. The position of string release latch 42 shown in FIG. 4 is maintained by spring 78 as previously mentioned. After actuation of the trigger 28 to a position shown in FIG. 4, the bias force of spring 94 acting on trigger stop 68 will return the rocker latch 54 and trigger to a position which is substantially as shown in FIG. 3. Thereafter, subsequent cocking of the bowstring and insertion into slot 30 will result in pressure being applied to string release latch 42 to pivot it back to the position shown in FIG. 3, with sear surfaces 62 and 70 engaged for retention of string release latch 42 in its string engaging position.

As shown in FIG. 4, actuation of trigger 28 causes pivoting of the rearward portion 48 thereof upward, with the rear edge of the upper surface 52 bearing against rocker latch member 54 to cause pivoting thereof about pivot point 58. Pivoting of the rearward portion of rocker latch member 54 causes resulting pivoting of sear surface 62 downward for disengagement of sear surface 70 of the string release latch 42 for firing of the crossbow. The interaction between arm 48 of trigger 28 and the rocker latch member 54 provides smooth trigger actuation with reduced pull force being necessary for actuation of the trigger mechanism 20. For highly accurate shooting with a crossbow, it is imperative that actuation of the trigger mechanism be smoothly achieved upon a constant force being applied to the pull point of trigger 28 at 44. It is desirable that the pull weight of the trigger mechanism 20 be as low as possible while maintaining safety. For safe operation, it is undesirable to provide a trigger mechanism having "hair trigger" characteristics, wherein surface contact between sear surfaces 62 and 70 is reduced until only a slight amount of pivotal movement of rocker latch member 54 results in disengagement of sear surface 70. Alternatively, in the present invention, it is desired to reduce pull weight associated with the trigger mechanism while providing full engagement between sear surfaces 62 and 70 for safe operation of the trigger. The cooperation between the trigger 28 and rocker latch member 54 enables pull weight of the trigger to be reduced due to the translation of force between the rear upper edge 52 of trigger 28 to the rear arm 64 of rocker latch member 54. In the preferred embodiment, the distance between pivot point 50 and 58 is such that clearance exists between arm 48 of trigger 28 and rocker latch member 54. Upon pivoting of the trigger about pivot point 50, portion 52 of the trigger 28 moves upward to bear against arm 64 of rocker latch member 54 to cause initial pivoting thereof. Further pivoting of trigger 28 about pivot point 50 causes relative sliding movement between portion 52 and the rocker latch member 54, with bearing surface 52 acting upon arm 64 during this sliding movement and applying force to the rocker latch member 54 for pivoting thereof.

Figure 5A:
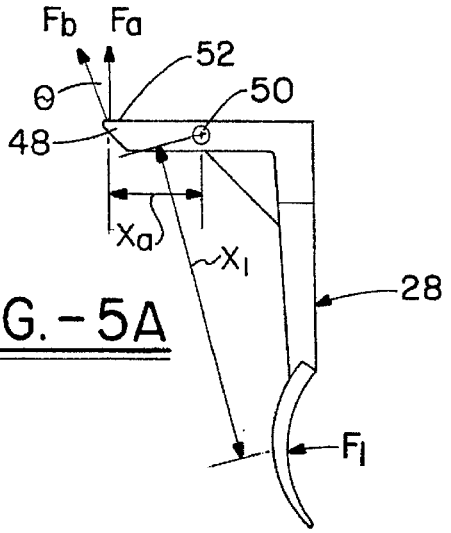
FIG. 5A is a side elevational view of the trigger member of the trigger mechanism shown in FIG. 3, showing actuating forces applied thereby.
Figure 5B:
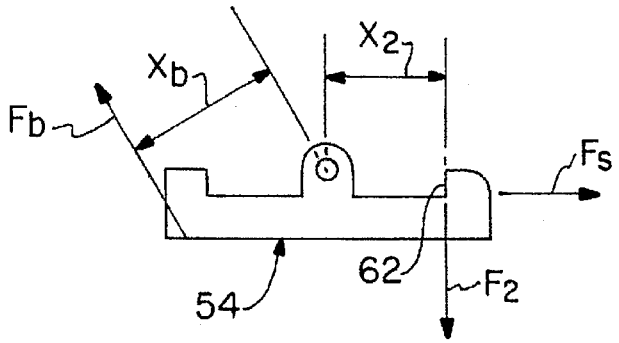
FIG. 5B is a side elevational view of the rocker latch member of the trigger mechanism as shown in FIG. 3, showing actuating forces applied to and through the rocker latch member.

In FIGS. 5A and 5B, the actuating forces associated with the trigger mechanism will be described. The pull weight force needed to actuate the trigger is shown at $F_1$ of FIG. 5A, which in turn will cause pivoting of the trigger about pivot point 50 as previously described. Upward force applied through the rear arm 48 of trigger 28 produces a force component, labeled $F_b$, which acts upon the rocker latch member 54. A mechanical advantage is provided through the trigger 28, transferring the force $F_a$ into force $F_b$. The force $F_a$ is the resultant force from the force applied at the trigger pull point $F_1$, about the pivot point 50 of trigger 28. The trigger pin moment is defined by the lengths $X_1$ and $X_a$ with $F_a$ defined by the following equation:

$$F_a=(F_1X_1)/X_a$$

Translation of force $F_a$ into force $F_b$, which comprises the force which will be applied through the rocker latch member 54 and moment arm created thereby. As shown in FIG. 5B, the force $F_b$ is applied through the rocker latch member 54 about moment arm $X_b$, $X_2$, resulting in a disengagement force $F_2$ at the location of the sear surface 62. A sear force is also applied to sear surface 62 through the string release latch 42, labelled $F_s$. The force $F_s$ relates to the force applied by a bowstring in the cocked position. The force, $F_b$, applied through the rocker latch member 54 is defined as follows:

$$F_b=F_a/\cos\theta$$

with the resulting disengagement force $F_2$ defined as follows:

$$F_2=(F_bX_b)/X_2$$

The split trigger and rocker latch member design has several extremely advantageous characteristics which make it useful for improving the smoothness and accuracy with which a drawn bowstring is released from the trigger mechanism. The trigger design reduces overall travel to disengage the sear surfaces 62 and 70. The overall trigger pull force is proportional to the coefficient of friction between the bearing surfaces of the trigger 28 and rocker latch arm 54. The trigger mechanism also provides an increasing trigger pull force as the mechanism is operated. The trigger mechanism therefore offers versatility in allowing the user the flexibility of choosing between trigger pull force and trigger travel by means of the relative sliding action between the rocker latch arm 54 and the trigger 28, resulting in differential motion between these two components. As trigger pull force is also proportional to the coefficient of friction between these members, reductions in trigger pull force may be obtained by reducing the coefficient of friction.

In the design of the trigger mechanism, the pounds of force necessary to disengage sear surface 62 of the rocker latch member 54 from sear surface 70 of the string release latch 42 is reduced by translating force $F_a$ into $F_b$ as applied to the rocker latch member 54. This translation of force in turn creates a significant mechanical advantage with respect to rocker latch member 54 to result in reduced pull weight $F_1$ as associated with trigger 28. The lighter trigger pull weight necessary to actuate the trigger mechanism 20 in the present invention is accomplished without sacrificing the extent of engagement between sear surfaces 62 and 70, maintaining safety requirements. The interaction between trigger 28, rocker latch member 54 and string release member 42 also provides additional advantages which enhance operation of the trigger to allow smoother string release and higher accuracy shooting. In the trigger design, the pull force $F_1$ increases as the trigger is pulled, with initial pull force to initiate rearward movement of the trigger being significantly reduced. By providing a reduced initial pull force, and thereafter a smoothly increasing pull force on the trigger, the trigger "feel" apparent to the user is a reduced pull force which is smoother in operation. This initial trigger pull force may also be reduced by lowering the coefficient of friction between the trigger 28 and rocker latch arm 54 as previously mentioned.

Figure 6:
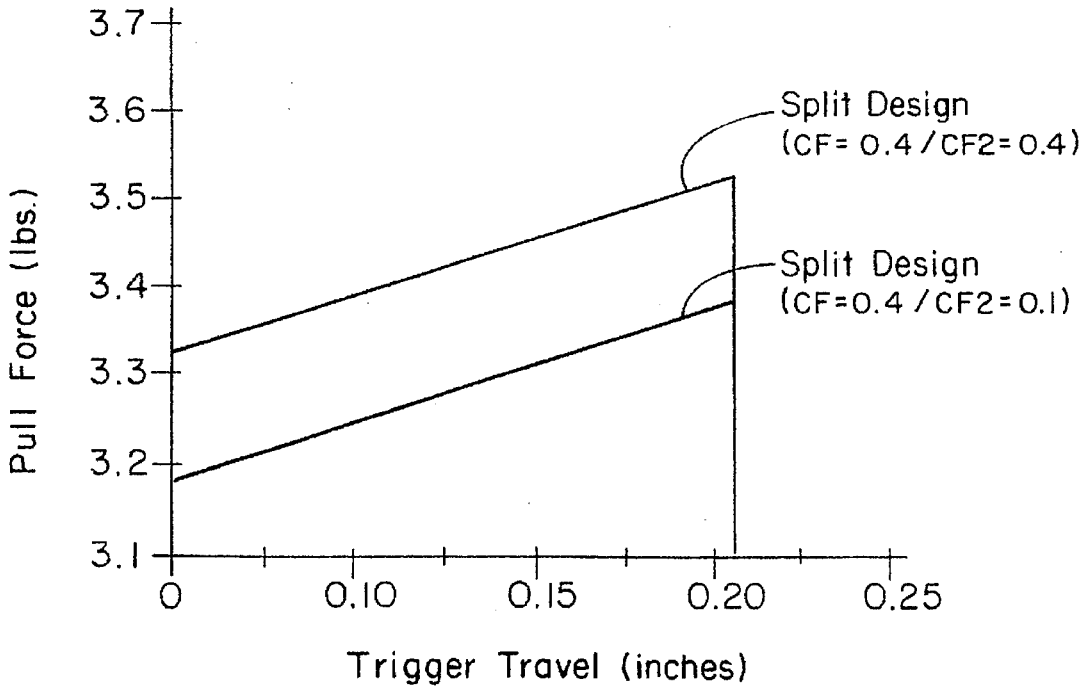
FIG. 6 is a plot of trigger travel versus force for the embodiment of the trigger mechanism as shown in FIG. 3.

Another aspect of the trigger design is found in a significant reduction in the amount of trigger travel necessary to affect disengagement of the sear surface 62 from sear surface 70 for release of a drawn bowstring. The pivoting of rocker latch member 54 by means of trigger 28 and the relationship between these components enables disengagement of the sear surfaces with less movement of a user's fingers to again improve accuracy. As seen in FIG. 6, the relationship between trigger travel and the trigger pull force is shown. It is seen that the trigger pull force increases during travel of the trigger, until the sear surfaces 62 and 70 disengage. The split design between the trigger 28 and rocker latch arm 54 also reduces overall trigger travel in association with increasing trigger pull force as the mechanism is operated. These characteristics offer significant advantages over a unitary design for example, in that, the trigger pivot point 50, being located a predetermined distance below the pivot point 58 associated with the rocker latch 54, enables the predetermined amount of pivotal movement of latch 54 to be obtained with less corresponding pivotal movement of trigger 28. Also shown in FIG. 6, is a reduced initial trigger pull force and overall pull force as the mechanism is operated, based upon a reduction of the coefficient of friction between the bearing surfaces of trigger 28 and rocker latch member 54. For example, a permanent lubricant may be disposed between the two surfaces, or other suitable means to reduce the coefficient of friction accordingly. In FIG. 6, the difference based upon a reduction of the coefficient of friction between these surfaces are shown in the force/travel curves, with a coefficient of friction of (CF=0.4) v. (CF=0.1).

Figure 7:
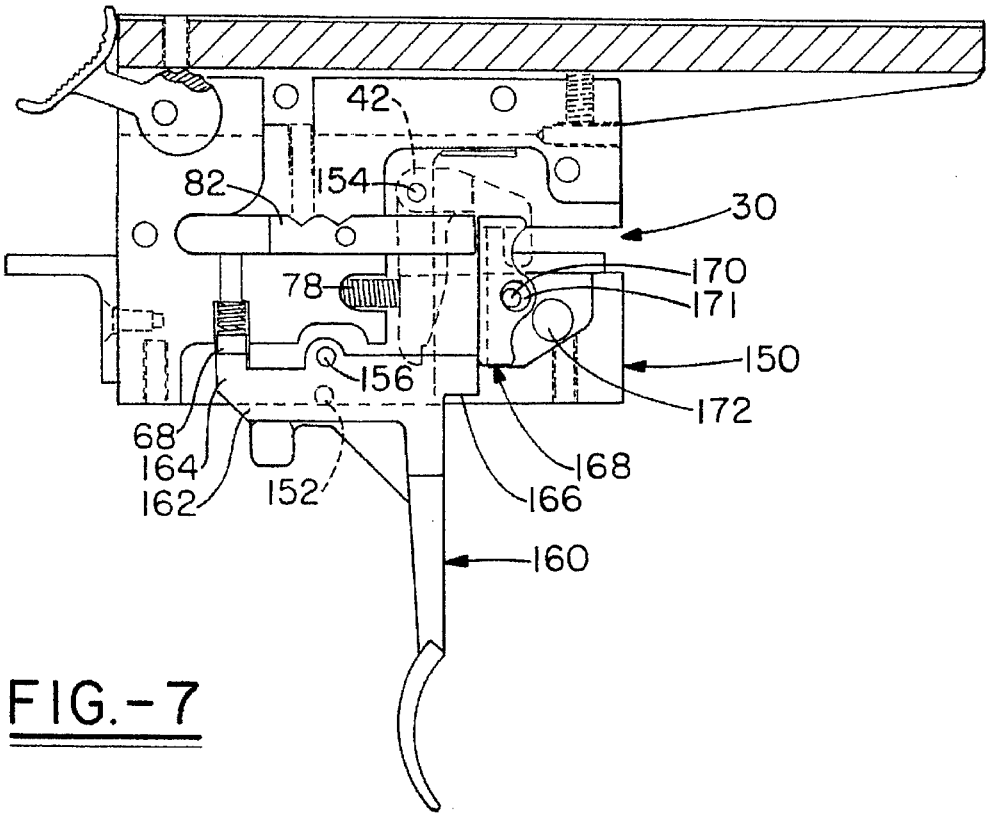
FIG. 7 is a side elevation view of another embodiment of the trigger mechanism shown in FIG. 2, with half of the outer housing removed, the trigger mechanism shown in a bow string retaining position.
Figure 8:
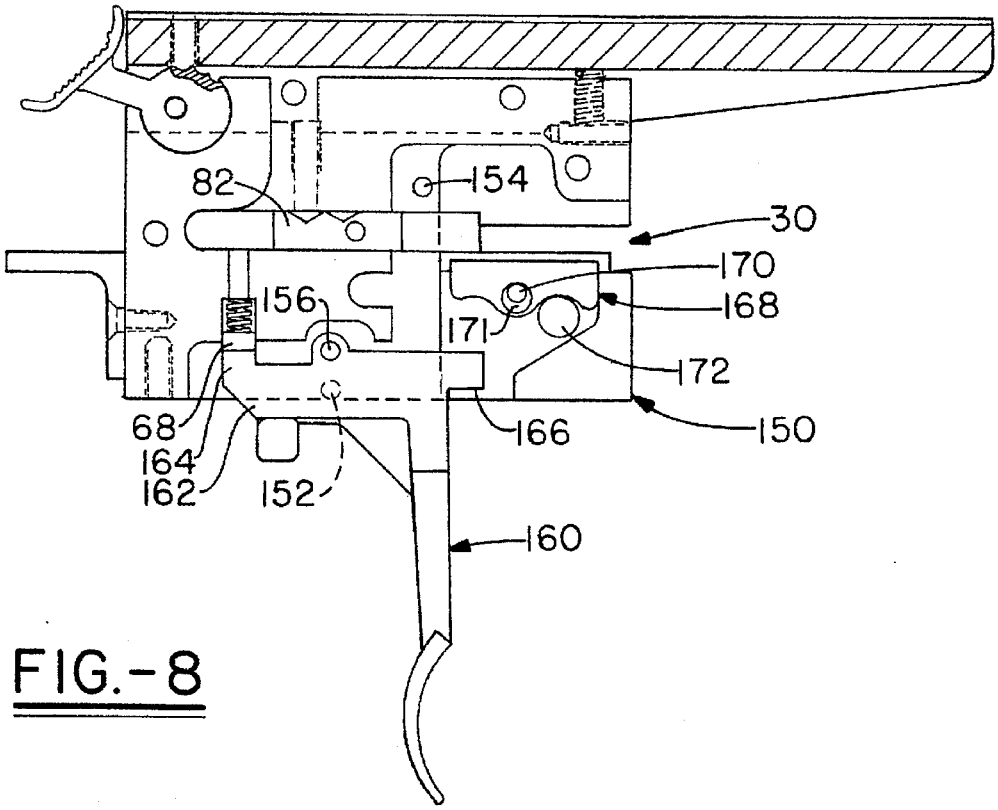
FIG. 8 is a side elevation view of the trigger mechanism as shown in FIG. 7, with the trigger actuated to release a bowstring.

Another embodiment of the trigger mechanism of the invention is shown in FIGS. 7 and 8, wherein the trigger housing of the trigger mechanism is provided to accommodate a trigger mechanism similar to that shown in the embodiment of FIG. 3, as well as a simplified, less costly trigger mechanism. In this embodiment, the trigger housing generally indicated at 150 allows interchangeability of alternative trigger mechanisms within the same housing. The trigger mechanism of the embodiment shown in FIG. 3 may be used with trigger housing 150, by providing a removable pivot pin at 152 for mounting the trigger member 28 (not shown) of the embodiment of FIG. 3. The separate rocker latch member 54 (not shown) may be mounted on pivot pin 156, and a string release latch 42 (shown in ghost in FIG. 7) may then be mounted on pivot pin 154, and a bias spring 78 (shown in ghost) is provided in the cavity formed in the trigger housing to form the trigger mechanism as in the embodiment of FIG. 3. Alternatively, the trigger housing 150 may also be used to accommodate another trigger mechanism, which is somewhat simplified and less costly to produce, with the interchangeability of the trigger mechanisms providing flexibility and economical manufacturing procedures. The alternative trigger mechanisms shown in FIGS. 7 and 8 includes a trigger member 160 mounted on pivot pin 156 being the same pivot pin on which the rocker latch member 54 of the previous embodiment would be mounted. The trigger member 160 includes a rearward extending portion 162 including an upwardly extending boss 164 which is acted on by trigger stop 68 as in the embodiment of FIG. 3. The trigger stop 68 operates in a similar manner to the embodiment of FIG. 3, in association with the safety slide 82, and reference should be made to the description of the embodiment of FIG. 3 in this respect. The trigger member 160 also includes a forward extending portion 166, providing an abutting surface for a string release member 168 mounted on a removable pivot pin 170 provided within housing 150. The string release member 168 may be mounted on pivot pin 170 by means of a bias spring 171 which biases the string release member to its string engaging position as shown in FIG. 7, wherein rotation of the string release member 168 in either clockwise or counterclockwise directions is limited by means of stop member 172. Also provided within housing 150 is a string release stop member 172 which limits pivotal motion of the string release member 168. In FIG. 7, the string release member 168 is shown in its string engaging position, with a portion thereof extending downwardly from pivot pin 170 to engage the front surface of forward extending portion 166 of trigger member 160. A portion of the string release member 168 also extends upward into the forward opening bowstring slot 30 so as to retain a drawn bowstring within slot 30. It should be recognized that in this position, a drawn bowstring will apply a forward force on string release member 168 to force the lower portion thereof against portion 166 of trigger member 160. In operation, as the bowstring is drawn into slot 30, the biased string release member 168 is pivoted rearward by the force of the bowstring, with the bowstring engaging the safety slide 82 to set the safety as in the previous embodiment. After the bowstring has been pulled rearward to the extent to get behind the string release member 168, it is biased back to the position as shown in FIG. 7, to retain the drawn bowstring within slot 30. Actuation of the trigger member disengages the string release member 168, to allow pivotal motion of string release member 168 and release of the bowstring. Although providing a somewhat stiffer trigger pull and increased pull weight force needed to actuate the trigger, the trigger mechanism including trigger member 160 and string release member 168 can be produced at lower cost and provides flexibility in the design of the trigger mechanism. The interchangeability of the trigger mechanisms in the trigger housing 150 provides distinct advantages for this purpose. Other features of the alternative trigger mechanism may be similar to that of the previous embodiment if desired.

In another aspect of the invention, it is desirable to provide a height adjusting mechanism used to raise or lower the position of the sight bridge 36 and a sighting means used therewith. With reference to FIG. 4, the height adjusting mechanism may be provided as a cam member 100, adjusted by means of lever 40, with the sight bridge 36 riding upon the camming mechanism 100 to adjust its height. Providing the sight adjustment mechanism integral to the trigger assembly allows uniform and precise adjustment of a sighting means in a simplified and efficient manner. The integral construction further allows adjustment of the sight bridge for any particular user. As previously mentioned, a set screw 102 is preferably used in association with cam member 100 to set the relative height of the sight bridge 36 at its rearward extent. Varying the position of a set screw 102 relative to the trigger housing will allow the sight bridge 36 to be adjusted to the eye of any particular user in association with the lengthwise travel available on bridge 36. Further, sight bridge 36 provides an attaching surface of significant length, allowing optical devices to be mounted at any point along the surface, providing increased or decreased field of view with the optical device as it positioned relative to the eye of the user.

Figure 9:
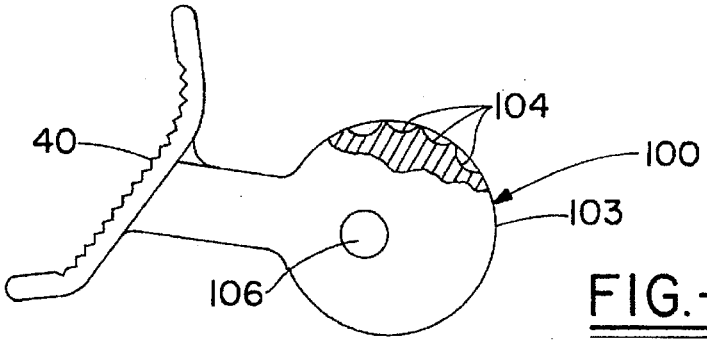
FIG. 9 is a partial cut-away view of an embodiment of a sight adjusting mechanism for adjusting a rear sight, formed as an integral part of the trigger mechanism of the invention.

Turning to FIG. 9, the cam mechanism 100 is shown in more detail as an example of a height adjusting mechanism for use with sight bridge 36. In the preferred embodiment, the height adjustment cam mechanism 100 is formed as a substantially circular body having a number of grooves or indentations 104 formed in an outer surface 103 thereof. The cam mechanism 100 includes a mounting aperture 106 positioned eccentrically relative to the outer surface 103, such that upon rotation of the camming mechanism 100 about a pivot pin positioned through hole 106, the exterior surface 103 acts as a camming surface for the sight bridge 36. The grooves or indentations 104 which may be formed in the exterior surface 103 or in another portion of cam mechanism 100, such as the side surface thereof. The grooves or indentations 104 are designed to coact with the set screw 102 or other suitable structures associated with sight bridge 36 to provide a plurality of preset heights for sight bridge 36. As an example, the grooves 104 may be provided to set sighting distances at progressive ten yard intervals or the like. Relative rotation of the camming mechanism 100 to the sight bridge 36 with which it cooperates is provided by means of lever 40 which is accessible exterior to the trigger housing 22 for adjustment by the user. As an alternative to the cam mechanism 100 shown in FIG. 9, the camming surface may be smooth for continuous height adjustment of the sight bridge, or another type of integral mechanism may be used to provide the height adjustment of the sight bridge. For example, the grooves 104 or cam surface 103 may be provided on a side portion rather than the outer surface, to exert force from the side as an alternative to the bias force provided by spring 104 as described in the embodiment of FIG. 3. Other alternative arrangements will be apparent to those skilled in the art, and are contemplated herein, with the integral nature of the height adjustment mechanism providing the distinct advantages as described.

Figure 10:
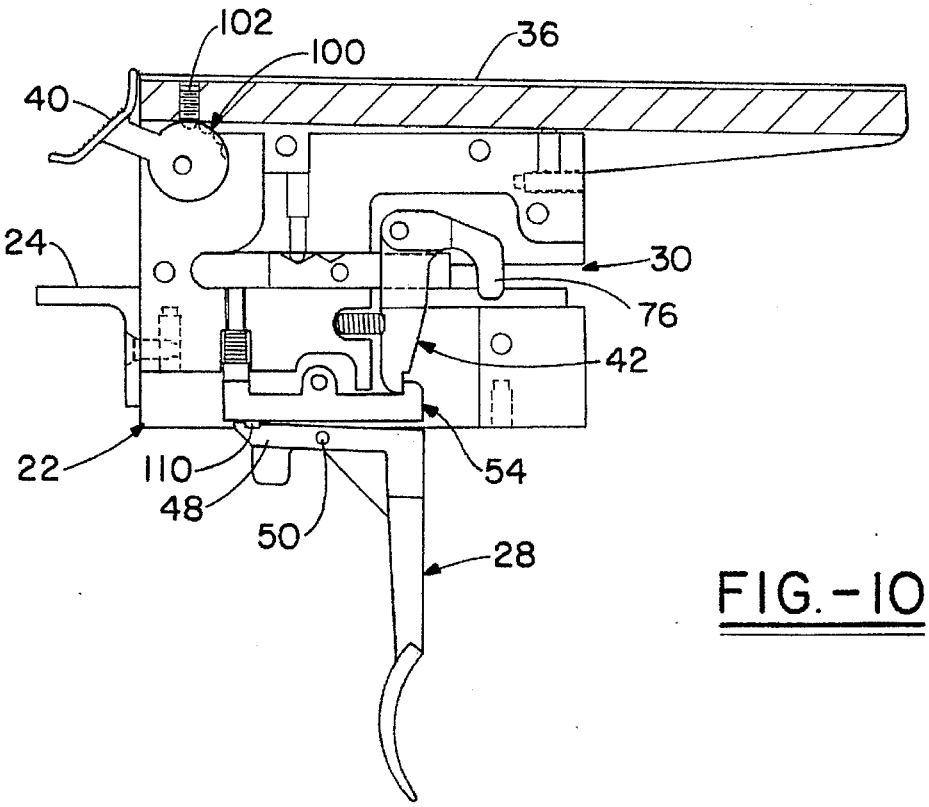
FIG. 10 is a cross sectional view of an alternate embodiment of the trigger mechanism of the invention.

In FIG. 10, there is shown an alternate embodiment of the invention, wherein to further enhance trigger actuation, the rearward portion 48 of trigger 28 is provided with a bearing means 110 provided at the rearward top portion 52 serving as the bearing surface between trigger 28 and rocker latch member 54. The bearing means 110 may be a roller bearing, needle bearing or the like to reduce frictional engagement between the translating surface 52 relative to the lower surface of rocker latch member 54. The bearing means 110 reduces frictional drag between the surfaces during translation, and thereby will facilitate again reducing trigger pull weight. The bearing means may be used as an alternative to the radiused surface or lubrication previously mentioned, or in addition thereto, and may alternatively be provided as a material having a low coefficient of friction to serve as an appropriate bearing surface.

Figure 11:
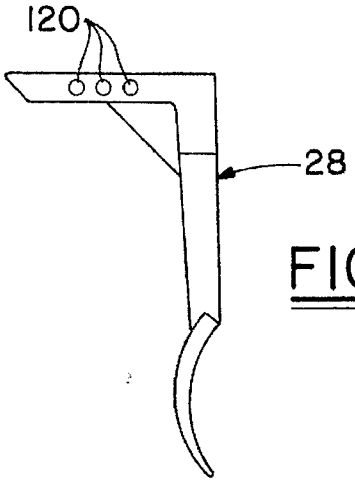
FIG. 11 is an enlarged partial view of an alternate embodiment of a trigger arm associated with the trigger mechanism of the invention.

In FIG. 11, an alternative embodiment for the trigger member 28 of the embodiment of FIG. 3 is shown. In this embodiment, the relative pull weight associated with the trigger 28 may be adjusted by repositioning trigger 28 within the trigger housing 22. The trigger 28 may be provided with a number of apertures 120 for mounting in association with a pivot pin 50 as previously described. The number of apertures enables the trigger 28 to be mounted at alternative relative positions to the rocker latch member 54 mounted on pivot pin 58 as previously described. It should be recognized that upon mounting of trigger 28 in an aperture positioned differently from that shown in the embodiment of FIGS. 3 and 4, an effect on trigger pull weight will be realized. In a preferred embodiment as shown in FIG. 11, the central hole 120 may be similarly positioned to that shown in FIGS. 3 and 4, with the right and left holes 120 providing alternative predetermined trigger pull weights. For example, if the trigger 28 is positioned to pivot about the right-most hole 120 the force necessary to overcome the force between the sear surfaces 62 and 70 as previously described will be increased. Similarly, mounting of trigger 28 to pivot about the left-most hole 120 would result in a reduction of force necessary to disengage the sear surfaces. Providing a plurality of holes 120 at various positions on trigger 28 allows a user to tailor the feel of the trigger mechanism to their own particular shooting style. This arrangement or another suitable arrangement to alter the pivot point of the trigger member offers versatility of choosing between trigger pull force and trigger travel. Depending on the placement of the pivot point, and the shape of the mating surfaces between the trigger member 28 and rocker latch member 54, reduced trigger travel can be realized with a corresponding increase in trigger pull force. Alternatively, reduced pull weight may be realized with an increase in trigger travel if desired. This type of adjustment is possible due to the relative sliding action between the rocker latch arm 54 and the trigger member 28, resulting in differential motion between the two components. Again, initial trigger pull force may be reduced by use of a lubricant or other mechanism as described.

Based upon the foregoing preferred embodiments of the invention, it should be recognized that an improved crossbow trigger mechanism is provided, having a variety of unique attributes and advantages. The trigger mechanism in a preferred of the invention reduces trigger pull weight and trigger travel characteristics which improve the release characteristics of the trigger mechanism relative to a bowstring. The improved release characteristics improve shooting accuracy and repeatability of the crossbow. The trigger mechanism further includes integral height adjustment of an integral sight bridge improving use of the crossbow. The trigger mechanism may be housed in a separate compact housing which is positively secured within the crossbow, and in association with the trigger components provides improved release characteristics for the crossbow. The trigger housing may also allow interchangeability between various trigger mechanisms to allow flexibility of the design for a particular application. Although the invention has been described relative to various preferred embodiments, it is to be understood that various changes or modifications may be made in these embodiments without departing from the scope of the invention disclosed herein, and as set forth in the following claims.

What is claimed is:

1. A crossbow trigger mechanism, comprising:

a pivotal string release latch for releasably retaining a bowstring in a drawn position, said string release latch being pivotal about a first pivot point and having a first sear surface associated therewith;

a pivotal rocker latch member having a second sear surface associated therewith which engages said first sear surface to selectively prevent pivotal motion of said string release latch, said first and second sear surfaces lying substantially in a plane when engaged with one another and wherein said rocker latch member being pivotable about a second pivot point and having a portion thereof extending rearward of said second pivot point;

a pivotal trigger member operable to pivot said rocker latch member and disengage said first and second sear surfaces to allow pivotal motion of said string release latch, wherein pivoting of said string release latch releases said bowstring;

said trigger member being pivotable about a third pivot point and having a portion thereof extending rearward from said third pivot point, wherein said rearward extending portion of said trigger member applies force on the rearward extending portion of said rocker latch member to cause pivoting thereof for disengagement of said first and second sear surfaces, said second and third pivots points being positioned in spaced apart relationship in a plane which is substantially parallel to said plane of said sear surfaces.

2. The crossbow trigger mechanism as defined in claim 1, which further comprises a trigger housing which is positively secured within said stock portion of said crossbow by means of a tang member associated with said housing, said tang member having a portion thereof which is positively secured directly to said crossbow stock to prevent any relative movement between said crossbow stock and said trigger housing.

3. The crossbow trigger mechanism as defined in claim 2, wherein, said tang member is substantially L-shaped defining two portions which are substantially perpendicular to one another, with one of said portions being secured to said trigger housing, and the other of said portions being secured to said crossbow stock along an axis which is perpendicular to the longitudinal axis of said crossbow stock.

4. The crossbow trigger mechanism as defined in claim 2, wherein, said tang member is constructed of a material having characteristics to absorb vibration or shock forces generated during actuation of said trigger mechanism.

5. The crossbow trigger mechanism as in claim 4, wherein, said tang member is constructed of a glass reinforced nylon material.

6. The crossbow trigger mechanism as in claim 1, wherein, said trigger member includes a first bearing surface on said rearward extending portion which engages a second beating surface of said rearward extending portion of said rocker latch member, the cooperation between said first and second beating surfaces in cooperative engagement thereby enabling a pull weight of said trigger member to be reduced due to the translation of force between a rear upper edge of said trigger member and a rear arm of said rocker latch member as said trigger member is pivoted.

7. The crossbow trigger mechanism as in claim 6, wherein, said first and second bearing surfaces are made of a material having a low coefficient of friction.

8. The crossbow trigger mechanism as in claim 6, wherein, a lubricant is applied between said first and second bearing surfaces to reduce the coefficient of friction therebetween.

9. The crossbow trigger mechanism as in claim 6, wherein, said first and second bearing surface includes roller bearing means operable to reduce frictional engagement between said bearing surfaces.

10. The crossbow trigger mechanism as in claim 1, wherein, said string release latch includes a forward extending portion from said first pivot point, said forwardly extending portion having at least one downwardly extending fork portion for releasably retaining a bowstring upon pivoting of string release latch to a position wherein said first and second sear surfaces are engaged, and spring means acting upon said string release latch to bias said string release latch to a position wherein said at least one fork member is not in a position to retain a bowstring upon disengagement between said first and second sear surfaces.

11. The crossbow trigger mechanism as in claim 1, which further comprises a trigger housing which includes a string guide slot for receiving a bowstring, with said string release latch releasably holding said bowstring within said slot, said slot having dimensions which closely match the dimensions of said bowstring, such that upon release of said bowstring from said string release latch, said bowstring is substantially prevented from oscillating in a vertical direction as it is released from said trigger mechanism.

12. The crossbow trigger mechanism as defined in claim 1, wherein, a safety mechanism comprising a slide member disposed within a recess formed in a housing and slidable between first and second positions; and a trigger lock member extending between said rocker latch member and said recess, such that when said slide member is in said first position, said trigger lock member may extend into said recess, thereby allowing pivotal motion of said rocker latch member, and in said second position, said lock member is prevented from extending into said recess to inhibit pivotal motion of said rocker latch member to prevent release of said bowstring retained by said string release latch.

13. The crossbow trigger mechanism as defined in claim 12, wherein, said lock member is biased toward said rocker latch member by means of a spring acting on a portion thereof.

14. The crossbow trigger mechanism as defined in claim 12, wherein, said slide member includes a forward portion which extends past said string release latch and into a string guide slot associated with said housing, such that upon drawing of a bowstring into said slot, said slide member is engaged by said bowstring and is moved from said first position to said second position.

15. The crossbow trigger mechanism as defined in claim 1, wherein, said trigger member includes a plurality of mounting holes for pivotally mounting said trigger member in a housing, wherein mounting of said trigger member in a selected one of said plurality of mounting holes will provide a predetermined trigger pull weight for said trigger mechanism.

16. The crossbow trigger mechanism as in claim 1, comprises:

a sight bridge coupled to a trigger housing having means to engage a sighting means in association therewith for aiming of the crossbow; and an adjustment mechanism integral with said trigger housing to selectively adjust the height of at least a portion of said sight bridge relative to said trigger housing.

17. The crossbow trigger mechanism as defined in claim 16, wherein, said adjustment mechanism is a cam member having a camming surface acting upon said sight bridge, wherein relative movement between said camming surface and said sight bridge results in adjustment of the height of said sight bridge.

18. The crossbow trigger mechanism as defined in claim 17, wherein, said camming surface includes a plurality of grooves and said sight bridge includes means extending therefrom to cooperate with at least one of said grooves, wherein each of said grooves functions to position said sight bridge at a predetermined height relative to said trigger housing.

19. The crossbow trigger mechanism as in claim 18, wherein, said means extending from said sight bridge to cooperate with said camming surface is an adjustable set screw.

20. The crossbow trigger mechanism as in claim 17, wherein, said cam member is formed as a circular body, with said camming surface being the outer surface of said body, with said body being mounted in association with said trigger housing for rotation about a point positioned eccentrically relative to said camming surface, such that rotation of said body will vary the position of said camming surface relative to said sight bridge.

21. A crossbow trigger mechanism comprising, a trigger housing which is to be secured in association with a crossbow, said trigger housing including a plurality of removable pivot pins, with at least one of said pivot pins mounting a pivotal string release latch retained in association with said trigger housing for releasably holding a bowstring in a drawn position, and at least one other of said pivot pins mounting a trigger member operable to selectively allow pivoting of said string release latch, with pivoting of said string release latch, releasing said bowstring, wherein said plurality of pivot pins enable interchangeability between different string release latches and trigger members within the same trigger housing by the positioning of the pivot pin for the pivotal string release latch into at least two different pivot holes within the housing.

22. The crossbow trigger mechanism as in claim 21, wherein, said different string release latches include a string retaining portion which extends into a string guide slot which receives said bowstring, wherein said string retaining portion pivots either downward or upward relative to said string guide slot for said different string release latches.

23. The crossbow trigger mechanism as in claim 21, which further comprises:

a sight bridge coupled to said trigger housing having means to engage a sighting means in association therewith for aiming of the crossbow; and an adjustment mechanism integral with said trigger housing to selectively adjust the height of at least a portion of said sight bridge relative to said trigger housing.

24. The crossbow trigger mechanism as in claim 23 wherein, said adjustment mechanism is a cam member having a camming surface acting upon said sight bridge, wherein relative movement between said camming surface and said sight bridge results in adjustment of the height of said sight bridge.

25. The crossbow trigger mechanism as in claim 24, wherein said camming surface includes a plurality of grooves and said sight bridge includes means extending therefrom to cooperate with at least one of said grooves, wherein each of said grooves functions to position said sight bridge at a predetermined height relative to said trigger housing.

26. The crossbow trigger mechanism as in claim 25, wherein said means extending from said sight bridge to cooperate with said camming surface is an adjustable set screw.

27. The crossbow trigger mechanism as in claim 24, wherein said cam member is formed as a circular body, with said camming surface being the outer surface of said body, with said body being mounted in association with said trigger housing for rotation about a point positioned eccentrically relative to said camming surface, such that rotation of said body will vary the position of said camming surface relative to said sight bridge.

* * * * *